US009486849B2

(12) United States Patent
Moroi et al.

(10) Patent No.: US 9,486,849 B2
(45) Date of Patent: Nov. 8, 2016

(54) DOUBLE-ACTION EXTRUSION PRESS

(71) Applicant: Ube Machinery Corporation, Ltd., Ube (JP)

(72) Inventors: Yoshitaka Moroi, Ube (JP); Takeharu Yamamoto, Ube (JP)

(73) Assignee: Ube Machinery Corporation, Ltd. (JP)

( * ) Notice: Subject to any disclaimer, the term of this patent is extended or adjusted under 35 U.S.C. 154(b) by 100 days.

(21) Appl. No.: 14/419,790

(22) PCT Filed: Jul. 5, 2013

(86) PCT No.: PCT/JP2013/068547
§ 371 (c)(1),
(2) Date: Feb. 5, 2015

(87) PCT Pub. No.: WO2014/041881
PCT Pub. Date: Mar. 20, 2014

(65) Prior Publication Data

US 2015/0202672 A1 Jul. 23, 2015

(30) Foreign Application Priority Data

Sep. 12, 2012 (JP) ..... 2012-200050

(51) Int. Cl.

| | |
|---|---|
| ***B21C 31/00*** | (2006.01) |
| ***B21C 23/08*** | (2006.01) |
| ***B21C 23/21*** | (2006.01) |
| ***B21C 25/04*** | (2006.01) |
| ***B21C 37/06*** | (2006.01) |

(52) U.S. Cl.
CPC ..... *B21C 31/00* (2013.01); *B21C 23/085* (2013.01); *B21C 23/211* (2013.01); *B21C 23/217* (2013.01); *B21C 25/04* (2013.01); *B21C 37/06* (2013.01)

(58) Field of Classification Search
CPC ... B21C 31/00; B21C 23/085; B21C 23/211; B21C 25/04; B21C 37/06
See application file for complete search history.

(56) References Cited

U.S. PATENT DOCUMENTS

| | | | | |
|---|---|---|---|---|
| 3,649,816 | A * | 3/1972 | Johnes | B21C 31/00 700/206 |
| 3,709,013 | A | 1/1973 | Petsch | |
| 4,050,281 | A * | 9/1977 | Sibler | B21C 23/217 72/265 |
| 4,230,661 | A | 10/1980 | Asari et al. | |

FOREIGN PATENT DOCUMENTS

| | | |
|---|---|---|
| GB | 894737 | 4/1962 |
| JP | 49-26188 | 7/1974 |
| JP | 54-56967 | 5/1979 |
| JP | 61-205606 | 12/1986 |
| JP | 64-71518 | 3/1989 |
| JP | 5-28510 | 4/1993 |

* cited by examiner

*Primary Examiner* — Teresa M Ekiert
(74) *Attorney, Agent, or Firm* — DLA Piper LLP (US)

(57) ABSTRACT

A double-action extrusion press obtains a tubular product, wherein the pressure-receiving surface area of a cylinder chamber on the side from which hydraulic oil is discharged from a container cylinder and the pressure-receiving surface area on the rod-side chamber of a piercer cylinder are set to be the same when a container moves in the extrusion direction, and the cylinder chamber on the side from which hydraulic oil is discharged from the container cylinder and the rod-side chamber of the piercer cylinder are connected by an oil pressure conduit and are in communication with each other when a billet is extruded from the extrusion stem after piercing has been completed.

7 Claims, 4 Drawing Sheets

DOUBLE-ACTION EXTRUSION PRESS

TECHNICAL FIELD

The present invention relates to a double-action extrusion press which comprises a main ram inside of which is provided a piercer cylinder with a cylinder rod, which attaches to the front end of the rod a mandrel to be able to move in an axial direction in a main crosshead which is connected with the main ram, and which introduces pressurized fluid to a rod-side chamber of the piercer cylinder in the middle of extrusion to prevent advance of the mandrel and thereby obtain a tubular shaped extruded product.

BACKGROUND ART

In the past, there has been known an extrusion press which uses, for example, copper, aluminum, or an alloy of the same etc. to extrude a tubular product by double-action extrusion wherein a cylinder platen and end platen are arranged facing each other, the cylinder platen is provided with a main cylinder, main ram, extrusion stem, and mandrel, the end platen is provided with a die, and a container which can advance and retract by container cylinders is provided between the extrusion stem and the die.

The extrusion stem has a dummy block arranged at its front end and is attached through a main crosshead to the main ram which is assembled in the main cylinder which is provided at the cylinder platen. At the center position of the extrusion stem, the mandrel is arranged together with the piercer cylinder rod to be able to advance and retract accompanying the extrusion stem. Further, the die is attached to the end platen facing the extrusion stem.

Between the extrusion stem and the die, the container is arranged to be able to advance and retract. A billet is contained in the container. The billet which is contained in the container is pushed by movement of the extrusion stem to the die side for completion of upsetting. After upsetting, the mandrel advances and the billet is pierced, the mandrel stops at a predetermined advancing position of the die, and the extrusion stem again advances, so the billet is extruded as a tubular product by double-action extrusion.

In a double-action extrusion press, when the front end part of the mandrel is made to stop at a predetermined position of a bearing part of the die to extrude the product, the position of the mandrel is held so that the stop position does not deviate even if the relative position of the mandrel and the bearing part of the die is pulled by the product.

PLT 1 discloses a double-action extrusion press which is provided with a piercer cylinder which is provided inside a main cylinder and a stop which is forcibly connected with the mandrel off from an axial center of the extrusion press wherein the stop acts on a hydraulic pilot valve to start the feed of a fixed amount of pressurized fluid medium to a rod-side chamber of the piercer cylinder so as to hold a predetermined axial direction position of the bearing of the die (stop position) and wherein, further, control is performed to hold the position by making the amount of feed of the pressurized fluid medium match the increase in volume of the rod-side chamber of the piercer cylinder when the mandrel is still and the main ram advances.

In this regard, in the conventional type of double-action extrusion press, the hydraulic pilot valve is switched mechanically through the stop and connecting rod and a certain amount of pressurized fluid medium is fed so as to hold the mandrel at a predetermined position of the bearing part of the die, so a delay occurs in control by exactly the amount of the movement stroke corresponding to the land of the spool of the hydraulic pilot valve. During extrusion, the front end of the mandrel therefore moves back and forth by several millimeters with respect to the predetermined stop position.

Furthermore, when changing the front end position of the mandrel or when changing the extrusion speed, it is necessary to adjust the position of the stop and to adjust the amount of fluid and pressure supplied to the rod-side chamber of the piercer cylinder each time.

CITATIONS LIST

Patent Literature

PLT 1: Japanese Patent Publication No. 49-26188B2

SUMMARY OF INVENTION

Technical Problem

The present invention is made to solve the above problem and has as its object the provision of a double-action extrusion press for obtaining a tubular shape product which is provided with a mandrel holding means for holding a predetermined stop position at a bearing part of the die during extrusion without back or forth movement so as to suppress variation in the front end position of the mandrel.

Solution to Problem

The double-action extrusion press according to claim 1 of the present invention comprises a main crosshead which is adapted to be able to be pushed by a main cylinder in an axial direction and has an extrusion stem arranged at its front end, a piercer cylinder which can slide a mandrel in the extrusion stem and the main crosshead and is provided inside the main cylinder, container cylinders which can move a container which contains a billet in an axial direction, and a die stem which is inserted into the container, is facing the extrusion stem, and has a die arranged at its front end. In the double-action extrusion press, pressure receiving areas of cylinder chambers at the sides for discharging working fluid from the container cylinders when the container moves in the extrusion direction and a pressure receiving area of a rod-side chamber of the piercer cylinder are set the same, and, after completion of piercing when the extrusion stem pushes out the billet, the cylinder chambers at the sides for discharging working fluid from the container cylinders and a rod side of the piercer cylinder are connected by a hydraulic pipeline to be communicated with each other.

The double-action extrusion press according to claim 2 of the present invention provides the invention according to claim 1, which comprises pressurized fluid feeding means for feeding pressurized fluid to the communicated hydraulic pipeline.

The double-action extrusion press according to claim 3 of the present invention provides the invention according to claim 1 or claim 2, which comprises a ram nose at the front end of the extrusion stem, in which the container is pushed via the ram nose when extruding the billet.

The double-action extrusion press according to claim 4 of the present invention provides the invention according to any one of claim 1 to claim 3, which comprises means for measuring the positions of the extrusion stem and the mandrel in which during the movement of the extrusion stem in extrusion the double-action extrusion press controls the mandrel so as to maintain its position at the start of extrusion until the end of extrusion.

Advantageous Effects of Invention

The pressure receiving areas of the cylinder chambers at the sides where the container cylinders discharge the working fluid when the container moves in the extrusion direction and the pressure receiving area of the rod-side chamber of the piercer cylinder are made substantially the same and working fluid which is discharged from the container cylinders which are connected with the container which cooperates with the extrusion stem during extrusion is supplied through the hydraulic pipeline to the rod-side chamber of the piercer cylinder, so the front end position of the mandrel during extrusion can be held at a predetermined fixed position, control to hold the mandrel position can be easily performed, and the positional precision can be improved.

Even if changing the extrusion speed during the extrusion operation, there is no need to adjust the working fluid pressure or amount of fluid which is supplied to the rod-side chamber of the piercer cylinder each time and therefore the operability is improved.

The cylinder chambers at the sides discharging the working fluid when the communicated container moves in the extrusion direction and the rod-side chamber of the piercer cylinder are fed with pressurized fluid by the pressurized fluid feeding means, so the amounts of leakage of the two cylinders and the pressure drop are compensated for and control of the held position of the mandrel is improved.

The ram nose is arranged at the front end of the extrusion stem and the container is pushed by the extrusion stem via the ram nose, so supply of pressurized fluid to the container cylinders is unnecessary, no operation is necessary to set the speeds so that the speed of advance of the container and the speed of advance of the extrusion stem match, and the operability and controllability are improved.

The press has means for measuring the positions of the extrusion stem and mandrel and performs control so that the position of the mandrel at the time of start of extrusion is held until the end of extrusion during an extrusion operation, so fluctuations in position due to inertia of the mandrel or fluctuations in position of the mandrel due to fluctuations in load of the extrusion stem and, further, the amounts of leakage of the two cylinders and the pressure drop are compensated for and control of the held position of the mandrel is improved.

BRIEF DESCRIPTION OF DRAWINGS

FIG. 1(*b*) is a sectional view which schematically shows a double-action extrusion press according to the present invention which shows a state where a billet is contained in the container.

FIG. 1(*c*) is a sectional view which schematically shows a double-action extrusion press according to the present invention which shows a state where a mandrel has passed through the billet.

FIG. 1(*d*) is a sectional view which schematically shows a double-action extrusion press according to the present invention which shows a state after completion of extrusion.

DESCRIPTION OF EMBODIMENTS

Figure 1:
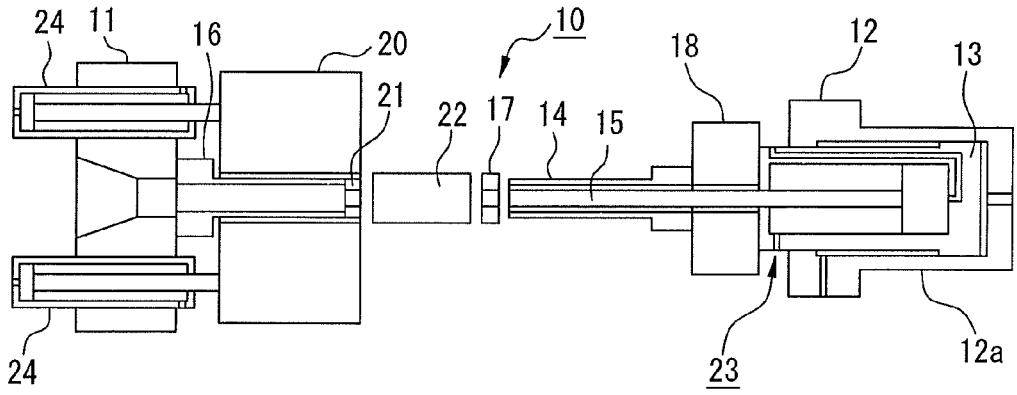
FIG. 1(*a*) is a sectional view which schematically shows a double-action extrusion press according to the present invention which shows a state before the start of extrusion.
Figure 1:
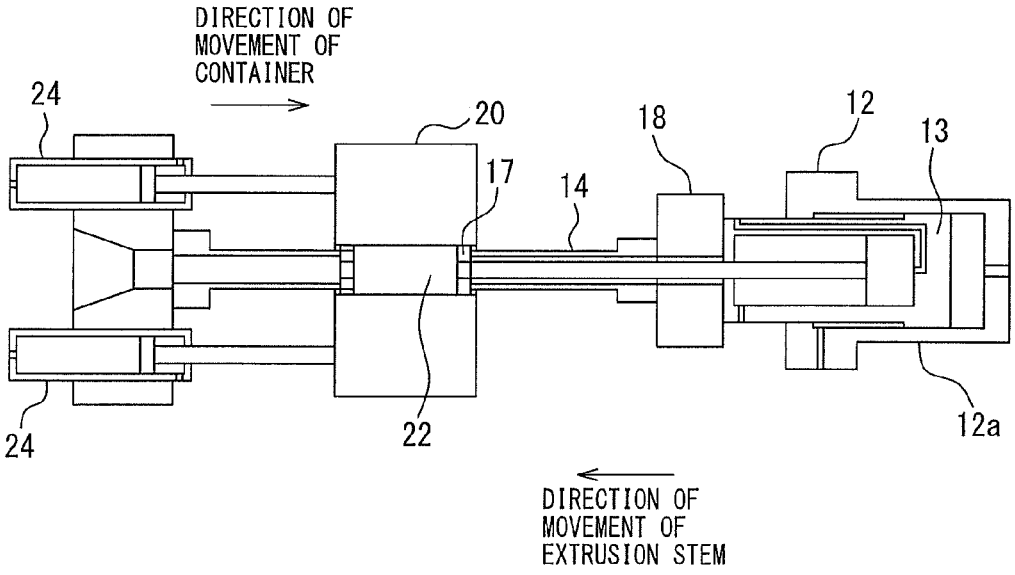
Figure 1C:
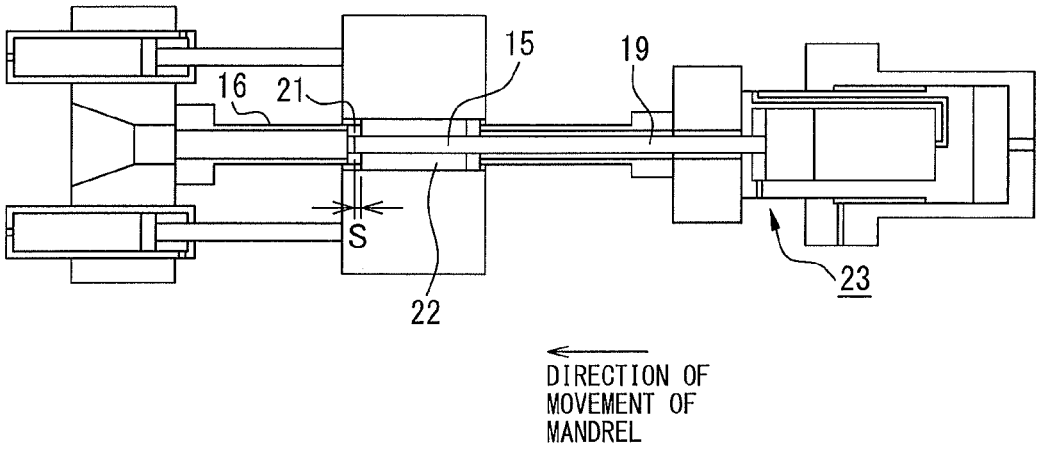
Figure 1D:
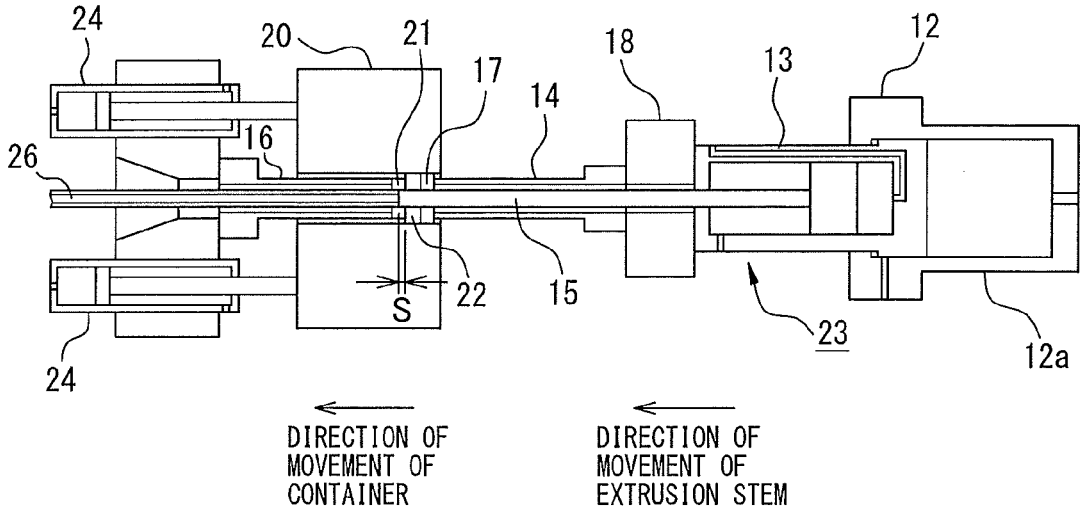

Below, the double-action extrusion press 10 according to the present invention will be explained using FIG. 1(*a*) to FIG. 1(*d*). FIG. 1(*a*) schematically shows the state before the start of extrusion, FIG. 1(*b*) shows the state where a billet is contained in a container, FIG. 1(*c*) shows the state where a mandrel is inserted through the billet, and FIG. 1(*d*) shows the state after completion of extrusion.

As shown in FIG. 1(*a*), the double-action extrusion press 10 includes an end platen 11 and a cylinder platen 12 facing each other. The end platen 11 is provided with a die stem 16, the cylinder platen 12 is provided with a main cylinder 12*a*, main ram 13, and extrusion stem 14. The extrusion press 10 further includes a container 20 which can advance or retract by container cylinders 24 arranged at the end platen 11 is provided between the die stem 16 and the extrusion stem 14.

The extrusion stem 14 has a dummy block 17 arranged at its front end and is attached through the main crosshead 18 to the main ram 13 which is assembled in the main cylinder 12*a* which is provided at the cylinder platen 12. At the center position of the extrusion stem 14, a mandrel 15 is arranged to advance and retract accompanying the extrusion stem together with the piercer cylinder rod 19. The die stem 16 which faces the extrusion stem 14 is attached to the end platen 11. At the front end of the die stem 16, a die 21 is provided. Reference notation 23 is a piercer cylinder which is provided in the main ram 13.

Further, reference notation 22 is a billet which is supplied between the container 20 and extrusion stem 14 together with the dummy block 17 by a not shown billet loader.

As shown in FIG. 1(*b*), between the two stems of the extrusion stem 14 and the die stem 16, the container 20 is arranged to be able to be advanced or retracted by the container cylinders 24. The billet 22 is placed in the container 20 together with the dummy block 17 by front-back movement of the extrusion stem 14 and retraction of the container 20. After that, the billet 22 which is contained in the container 20 is pushed by the two stems by the container 20 and extrusion stem 14 moving to the die stem 16 side for completion of upsetting.

After the end of upsetting, as shown in FIG. 1(*c*), the mandrel 15 advances, the billet 22 is pierced, and the mandrel 15 stops at a predetermined advancing position. The extrusion stem 14 and the container 20 advance by the same speed whereby, as shown in FIG. 1(*d*), the billet 22 is extruded as a tubular shaped extruded product 26.

The stop position of the mandrel 15 is set to a predetermined dimension S from the end face of the die 21.

Figure 2:
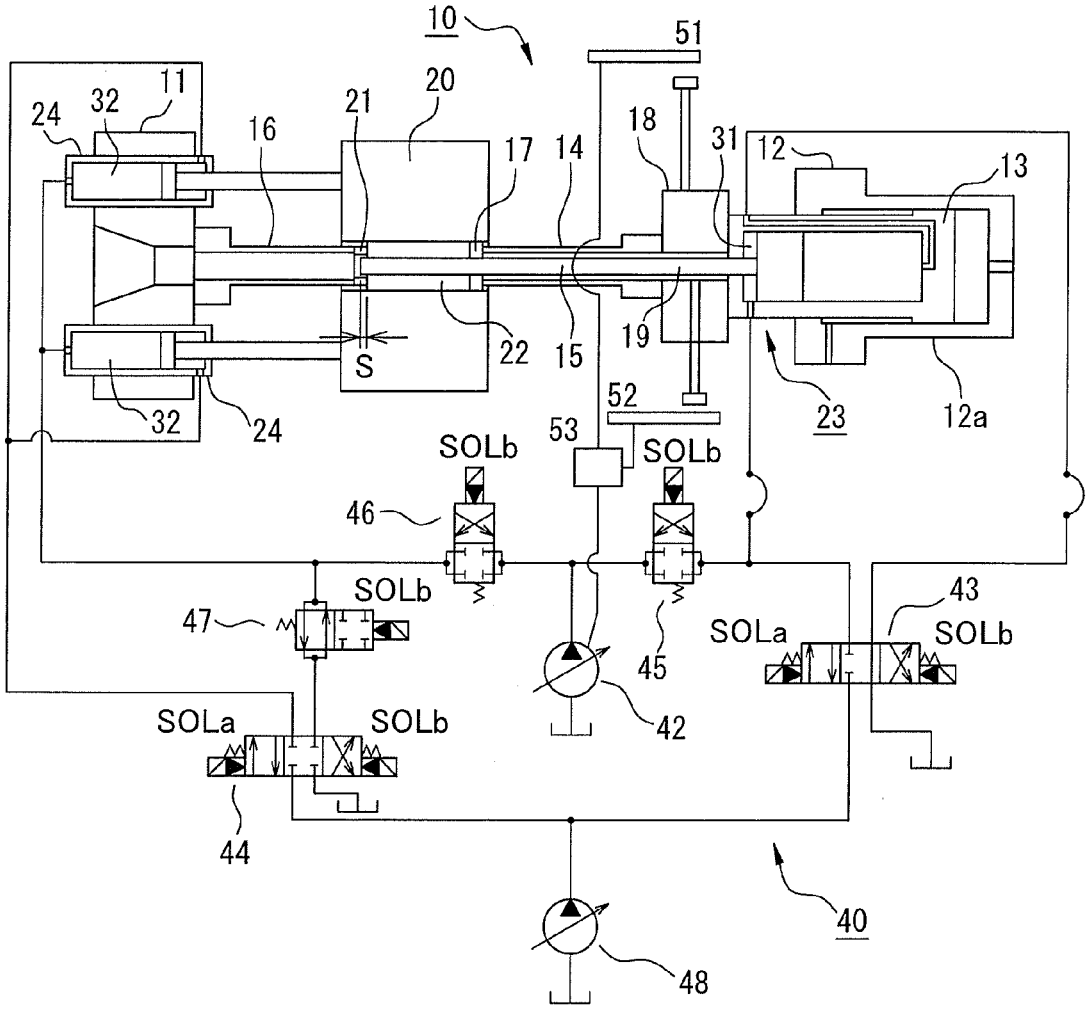
FIG. 2 is an explanatory view which shows an embodiment according to the present invention.

Next, an embodiment of the double-action extrusion press 10 according to the present invention will be explained in detail using FIGS. 2 and 3. FIG. 2 shows an embodiment according to the present invention, where reference notation 11 indicates an end platen, 12 a cylinder platen which is provided facing the end platen, 13 a main ram which is attached slidably in the main cylinder 12*a*, and 18 a main crosshead which is connected with the main ram 13. The main crosshead 18 is arranged to be able to slide on a not shown machine base. Note that, the end platen 11 and the cylinder platen 12 are configured to be held by not shown tiebars at a predetermined interval.

Inside the main ram 13, a piercer cylinder 23 is provided. At the front end of a piercer cylinder rod 19, a mandrel 15 is screwed through a not shown mandrel holder. The mandrel 15 is arranged to slide in the extrusion stem 14 which is attached to the front end of the main crosshead 18.

On the other hand, at the end platen 11, a die stem 16 which is provided with a die 21 at its front end part is provided to be able to be inserted in a billet-containing hole of the container 20. The container 20 which contains a billet 22 is arranged to be able to advance or retract by the plurality of container cylinders 24 which are provided at the end platen 11. Reference notation 17 is a dummy block which is arranged at the front end of the extrusion stem 14.

In FIG. 2, reference notation 31 indicates a rod-side chamber of the piercer cylinder 23. The pressure receiving area is set to A square centimeters. Reference notation 32 indicates a cylinder chamber of the container cylinder 24 at the side where working fluid is discharged when the container 20 moves in the extrusion direction. In FIG. 2, two container cylinders 24 are provided in this configuration, so the pressure receiving areas of the cylinders which are substantially the same are set to one-half of the A square centimeters of the pressure receiving area of the rod-side chamber of the piercer cylinder 23 (½A square centimeters). In FIG. 2, the container cylinders 24 are provided at the end platen 11 in this configuration, so the discharge side of the working fluid becomes the head sides of the cylinders when the container 20 advances in the extrusion direction. When using four container cylinders 24, the pressure receiving areas are set to one-fourth of the A square centimeters (¼A square centimeters).

A mandrel holding means of the present invention is configured to fluidically connect the rod-side chamber of the piercer cylinder 23 when extruding the billet 22 to the side where the working fluid is discharged when the container cylinders 24 advance, that is, in FIG. 2, the head side chambers of the container cylinders. In a double-action extrusion type extrusion press, the extrusion stem 14 and the container 20 advance matched with each other, so by the fluid connection, the working fluid which is discharged from the container cylinders 24 is supplied to the rod-side chamber of the piercer cylinder 23. For this reason, even if the extrusion stem 14 advances, it moves relatively without the front end of the mandrel 15 moving. As shown in FIG. 3, a predetermined stop position S from the end face of the die 21 is held and the front end position of the mandrel is restricted.

Figure 3:
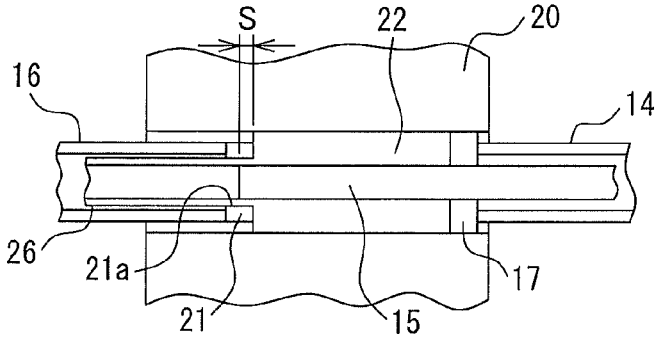
FIG. 3 is an explanatory view which shows an extrusion state where the front end of the mandrel is positioned at a bearing part of the die.

In FIG. 3, reference notation 26 shows a tubular extruded product which is extruded from the die 21, while 21*a* shows a bearing part of the die.

Referring to FIG. 2, the configuration of the hydraulic circuit 40 of the mandrel holding means according to the present invention will be explained. Reference notations 48 and 42 are variable discharge type hydraulic pumps which are driven by not shown electric motors. The variable discharge type hydraulic pumps 48 and 42 are provided with not shown known pressure regulating valves etc. The pressures are regulated and pressurized fluid is supplied to the cylinders. Reference notation 43 indicates a solenoid valve which operates a piercer cylinder 23 and 44 a solenoid valve which operates the container cylinders 24, while reference notations 45, 46, and 47 indicate solenoid valves which operate when connecting the rod-side chamber of the piercer cylinder 23 and the head side chambers of the container cylinders at the side where the working fluid is discharged when the container cylinders 24 advance.

The operation of the double-action extrusion press 10 which is configured as explained above will be explained. The billet 22 is placed on the billet loader together with the dummy block 17 and supplied to the extrusion center position where the main ram 13 is advanced to make the front end of the extrusion stem 14 contact the end face of the dummy block 17, so that the billet is gripped between the dummy block and the die stem 16. In that state, the container 20 is moved so as to load the billet in the billet through hole thereof. Then upsetting is performed. After upsetting, the SOLb of the solenoid valve 43 is energized to introduce pressurized fluid to the piston head side chamber of the piercer cylinder 23, thereby advance the mandrel 15 while piercing the billet 22. The SOLb of the solenoid valve 43 is deenergized so as to stop the front end of the mandrel 15 at a predetermined position (S) in the bearing part 21*a* of the die 21 to hold the position.

The predetermined stop position of the mandrel 15 shown in FIG. 3 is held by attaching scale sensors 51 and 52 to the main crosshead 18 and piercer cylinder rod 19 in advance, detecting the length of movement of the extrusion stem 14 in the extrusion direction and the length of movement of the mandrel 15 in the direction opposite to extrusion, and outputting the output signal from the control means of the controller to the variable discharge type hydraulic pump 42 (the relative positions of the mandrel 15 and die 21 are measured and determined in advance).

The invention is not limited to this so long as the front end part of the mandrel 15 is set to a predetermined stop position of the bearing part 21*a* of the die 21. Another method may also be used to determine the relative positions.

Further, as the scale sensors 51 and 52, for example, it is possible to use magnetostriction linear displacement sensors which detect the positions of detection use magnets so as to output positional information.

Next, the main ram 13 is again made to advance to make the extrusion stem 14 move and obtain a tubular shaped extruded product 26 which has a desired uniform thickness from the die 21. During extrusion, the SOLa of the solenoid valve 44 is energized to supply pressurized fluid to the rod sides of the container cylinders 24 and match the container 20 with the speed of advance of the extrusion stem 14. Further, the SOLb's of the solenoid valves 45 to 47 are energized and the head side chambers 31 of the container cylinders 24 and the rod-side chamber 32 of the piercer cylinder 23 are communicated with each other. As explained above, the pressure receiving areas of the head side chambers of the container cylinders 24 and the pressure receiving area of the rod-side chamber of the piercer cylinder are made substantially the same areas, so the working fluid which is discharged from the container cylinders 24 is used to make the piercer cylinder rod 19 move relatively matched with the speed of advance of the container. For this reason, the front end face of the mandrel 15 at the predetermined stop position of the bearing part 21*a* of the die 21 is constantly held at the predetermined stop position. During extrusion, positional control of the extrusion stem 14 and mandrel 15 for the front end position of the mandrel 15 to be held constant with respect to the die 21 is performed by the output of output signals of scale sensors 51 and 52 which are attached in advance to the main crosshead 18 and the piercer cylinder rod 19 from the control means of the controller 53 to the variable discharge type hydraulic pump 42. Deviation due to the leakage from both piercer cylinder 23 and container cylinders 24, pressure or volumetric efficiency, etc.

is corrected by supplying pressurized fluid from the variable discharge type hydraulic pump 42 to both cylinder chambers.

Further, at the time of end of extrusion, the SOLs of the energized solenoid valves are deenergized.

After the end of extrusion, if the pressurized fluid which pushes the main ram 13 to the advancing side is lowered in pressure and discharged and pressurized fluid is introduced to the rod side of the main ram 13 to contract the main ram 13 and retract the main crosshead 18, the extrusion stem 14 retracts. Next, pressurized fluid is supplied to the rod-side chamber 31 of the piercer cylinder 23 to retract and pull away the mandrel 15 from the remainder of the pushed billet 22. After this, the container 20 is further advanced to cut off the discard from the container 20 and the container 20 is further advanced to recover the die 21.

After recovering the die 21, the container 20 is slightly retracted and a new die 21 is inserted, the billet loader inserts a billet 22 and a dummy block 17 between the container 20 and the extrusion stem 14, and the container 20 is retracted in the state where the billet 22 and dummy block 17 are gripped between the end face of the die 21 and the front end face of the extrusion stem 14 so as to load the billet 22. After supplying the billet, the same operation is repeated.

Figure 4:
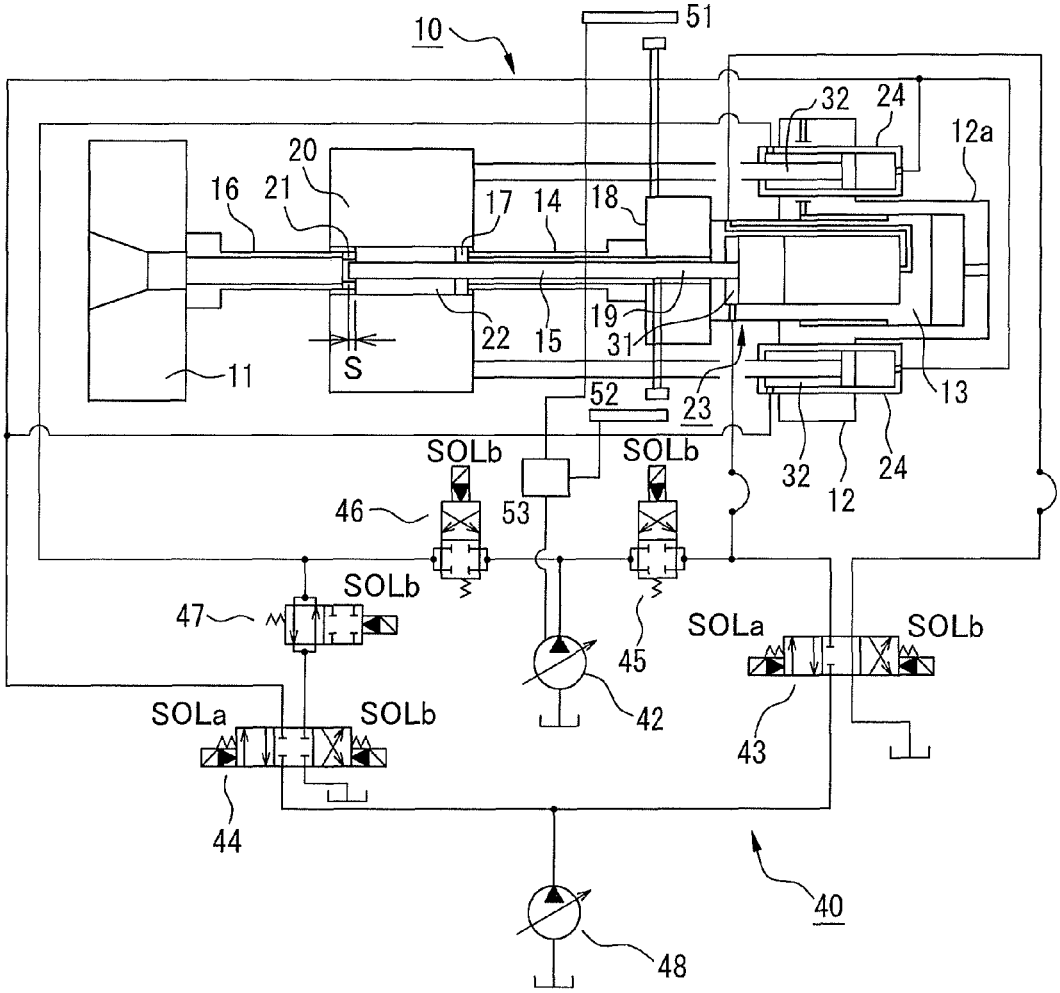
FIG. 4 is an explanatory view which shows another embodiment according to the present invention.

FIG. 4 shows another embodiment according to the present invention. The difference from FIG. 2 is that the container cylinders 24 are provided at the main cylinder 12 whereby the discharge side of the working fluid when the container cylinders 24 advance becomes the rod-side chamber of the cylinder. The rest of the configuration is configured in the same way as the above-mentioned FIG. 2. Therefore, during extrusion, the rod-side chamber pressure receiving surfaces of the container cylinders 24 and the rod-side chamber pressure receiving surface of the piercer cylinder 23 communicate and the pressure receiving areas are set substantially identically.

Figure 5:
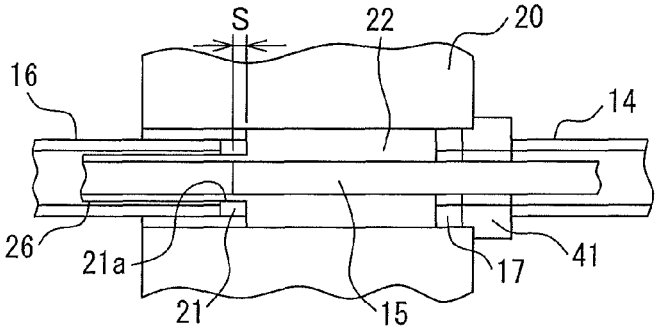
FIG. 5 is an explanatory view which shows another embodiment according to the present invention which arranges a ram nose at a front end of an extrusion stem.

FIG. 5 shows another embodiment according to the present invention and is configured by provision of a ram nose 41 between the front end of the extrusion stem 14 and the dummy block 17. The ram nose 41 is small in diameter at the front part where it is inserted inside the container and abuts against the dummy block 17 at the front end surface and is large in diameter at the back part where it abuts against end surface of the container 20 at the step part and against the extrusion stem 14 at the back end surface. When the extrusion stem 14 moves to advance, the container 20 moves to advance through the ram nose 41 and pushes the billet 22 which is inserted in the container 20 through the dummy block 17.

In FIG. 5, the ram nose 41 and the dummy block 17 and extrusion stem 14 are provided independently, but the invention is not limited to this. The ram nose 41 and the dummy block 17, the ram nose 41 and the extrusion stem 14, or the ram nose 41, dummy block 17, and extrusion stem 14 may be used in an integral configuration.

In the above-mentioned embodiments, the front end part of the piercer cylinder rod is provided with a mandrel through a not shown mandrel holder, but the invention is not limited to this configuration. For example, the front end part of the piercer cylinder rod may have a piercer crosshead provided with the mandrel attached to it through the mandrel holder and may be configured to move the piercer crosshead in the main crosshead in the axial direction. Further, a turning means for turning the mandrel is provided at the piercer crosshead in this configuration.

As explained above, the double-action extrusion press according to the present invention makes the cylinder pressure receiving areas of the cylinder chambers at the side discharging working fluid when the container moves in the extrusion direction and the pressure receiving area of the rod-side chamber of the piercer cylinder substantially the same and supplies working fluid which is discharged from the container cylinders which are connected to the container match with the extrusion stem during extrusion to the rod-side chamber of the piercer cylinder in configuration, so basically it is possible to hold the front end position of the mandrel during extrusion at a predetermined set position, control of the mandrel position retention becomes easy, and the positional precision can be improved.

Further, even if changing the extrusion speed or the front end position of the mandrel, there is no need to adjust the working fluid pressure or amount of fluid which is supplied to the piercer cylinder and therefore the operability is improved.

In a configuration arranging a ram nose at the front end of the extrusion stem, the container and the piston rods of the container cylinders are pushed by the extrusion stem whereby they move to advance matched with each other, so the supply of pressurized fluid to the container cylinders at the time of extrusion is unnecessary. The operation for setting the speed of advance can be omitted, so the work efficiency is improved.

On top of that, by using output signals of the extrusion stem scale sensor and the mandrel scale sensor which are attached in advance to the main crosshead and the piercer cylinder rod to control the discharge rate of the variable discharge type hydraulic pump, the front end position of the mandrel can be maintained, so the operating ability is improved and furthermore the quality also is stably improved.

Note that, the present invention is described in detail based on specific embodiments, but a person skilled in the art can made various changes, corrections, etc. without departing from the claims and concepts of the present invention.

DESCRIPTION OF REFERENCE NOTATIONS

10 double-action extrusion press
11 end platen
12 cylinder platen
12*a* main cylinder
13 main ram
14 extrusion stem
15 mandrel
16 die stem
17 dummy block
18 main crosshead
19 piercer cylinder rod
20 container
21 die
22 billet
23 piercer cylinder
24 container cylinder
26 tubular extruded product
31 piercer cylinder rod-side chamber
32 container cylinder working fluid discharge side chamber at time of advance for extrusion
41 ram nose
42 variable discharge type hydraulic pump
51 extrusion stem scale sensor
52 mandrel scale sensor
53 controller
S stop position of front end of mandrel

The invention claimed is:

1. A double-action extrusion press comprising:

a main crosshead which is adapted to be able to be pushed by a main cylinder in an axial direction and has an extrusion stem arranged at its front end;

a piercer cylinder which can slide a mandrel in said extrusion stem and said main crosshead and is provided inside said main cylinder;

container cylinders which can move a container which contains a billet in an axial direction; and a die stem which is inserted into said container, is facing said extrusion stem, and has a die arranged at its front end, wherein pressure receiving areas of cylinder chambers at the side for discharging working fluid from said container cylinders when said container moves in the extrusion direction and a pressure receiving area of a rod-side chamber of said piercer cylinder are set the same, and after completion of piercing when said extrusion stem pushes out said billet, said cylinder chambers at the sides for discharging working fluid from said container cylinders and a rod side of said piercer cylinder are connected by a hydraulic pipeline to be communicated with each other.

2. The double-action extrusion press according to claim 1, comprising pressurized fluid feeding means for feeding pressurized fluid to said communicated hydraulic pipeline.

3. The double-action extrusion press according to claim 2, comprising a ram nose at the front end of said extrusion stem, wherein the container is pushed via said ram nose when extruding said billet.

4. The double-action extrusion press according to claim 2, comprising means for measuring the positions of said extrusion stem and said mandrel, wherein during the movement of said extrusion stem in extrusion, the double-action extrusion press controls the mandrel so as to maintain its position at the start of extrusion until the end of extrusion.

5. The double-action extrusion press according to claim 1, comprising a ram nose at the front end of said extrusion stem, wherein the container is pushed via said ram nose when extruding said billet.

6. The double-action extrusion press according to claim 5, comprising means for measuring the positions of said extrusion stem and said mandrel, wherein during the movement of said extrusion stem in extrusion, the double-action extrusion press controls the mandrel so as to maintain its position at the start of extrusion until the end of extrusion.

7. The double-action extrusion press according to claim 1, comprising means for measuring the positions of said extrusion stem and said mandrel, wherein during the movement of said extrusion stem in extrusion, the double-action extrusion press controls the mandrel so as to maintain its position at the start of extrusion until the end of extrusion.

* * * * *